US007768490B2

(12) United States Patent
Huang et al.

(10) Patent No.: US 7,768,490 B2
(45) Date of Patent: Aug. 3, 2010

(54) COMMON VOLTAGE COMPENSATION DEVICE, LIQUID CRYSTAL DISPLAY, AND DRIVING METHOD THEREOF

(75) Inventors: Hsin-Chung Huang, Taipei County (TW); Yi-Nan Chu, Changhua Hsien (TW); Hung-Shiang Chen, Taipei County (TW); Juin-Ying Huang, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1040 days.

(21) Appl. No.: 11/460,636

(22) Filed: Jul. 28, 2006

(65) Prior Publication Data

US 2008/0024417 A1 Jan. 31, 2008

(51) Int. Cl.
*G09G 3/36* (2006.01)

(52) U.S. Cl. ..... 345/96; 345/204; 345/94; 345/97; 345/98; 345/100

(58) Field of Classification Search ..... 345/204, 345/94–100
See application file for complete search history.

(56) References Cited

U.S. PATENT DOCUMENTS 5,301,047 A * 4/1994 Hoshino et al. ..... 345/95
5,307,084 A * 4/1994 Yamaguchi et al. ..... 345/58
6,222,516 B1 * 4/2001 Oda et al. ..... 345/94
6,492,970 B1 * 12/2002 Furuhashi et al. ..... 345/94
6,822,632 B2 * 11/2004 Lee et al. ..... 345/95
7,091,943 B2 * 8/2006 Takeda et al. ..... 345/87
7,091,945 B2 * 8/2006 Yamazaki ..... 345/100
7,327,358 B2 * 2/2008 Tajiri et al. ..... 345/208
2002/0027540 A1 3/2002 Lee
2003/0058204 A1 * 3/2003 Moon ..... 345/87
2006/0152462 A1 * 7/2006 Furihata et al. ..... 345/98
2006/0214900 A1 * 9/2006 Tsuchi et al. ..... 345/98
2008/0266222 A1 * 10/2008 Feng ..... 345/87

FOREIGN PATENT DOCUMENTS

JP 2001-281663 10/2001

* cited by examiner

*Primary Examiner*—Richard Hjerpe
*Assistant Examiner*—Gregory J Tryder
(74) *Attorney, Agent, or Firm*—Jianq Chyun IP Office

(57) ABSTRACT

A common voltage compensation device suitable for a display panel of a liquid crystal display is provided. The common voltage compensation device includes a timing controller and a compensation circuit. The timing controller receives an image signal and generates control signals to the compensation circuit according to a determination mechanism. The compensation circuit sends a common voltage compensation signal to the display panel according to the control signals outputted from the timing controller in order to compensate the common voltage on the display panel. The determination mechanism performs an analysis of a gray scale distribution of a horizontal line signal of the image signal, and determines whether to compensate the common voltage according to an analysis result, and determines a polarity required to be compensated to perform the compensation when the compensation is needed.

13 Claims, 5 Drawing Sheets

COMMON VOLTAGE COMPENSATION DEVICE, LIQUID CRYSTAL DISPLAY, AND DRIVING METHOD THEREOF

BACKGROUND OF THE INVENTION

1. Field of Invention

The present invention relates to a liquid crystal display. More particularly, the present invention relates to a liquid crystal display with common voltage compensation.

2. Description of Related Art

FIG. 1 depicts a conventional pixel circuit of a liquid crystal display. Referring to FIG. 1, in the pixel circuit, a source terminal 116 of a thin film transistor 113 is electrically connected to a source line 101; a gate terminal 114 is electrically connected to a gate line 103; and a drain terminal 115 is electrically connected to a common electrode 107 through a storage capacitor 111 and a pixel electrode 109 connected in parallel. In the liquid crystal display, there is a parasitic capacitor 105 between the source line 101 and the common electrode 107 due to the inherent process factors of the array circuit of the display panel.

Under the effect of the above parasitic capacitor 105, when the display panel displays certain particular frames, the voltage on the common electrode (hereinafter "common voltage") will change due to the coupling effect generated by the parasitic capacitor 105, thus resulting in uneven luminance when the display panel displays the particular frames. The particular frames can be a frame with a black block, a white block and other gray scale block. For example, when a white frame with a black block 201 as shown in FIG. 2 is displayed, the luminance of two side regions 202 and 203 of the black block 201 will not be the same as that of the region 204 or 205 owing to the coupling effect generated by the parasitic capacitor 105.

If the influence of the coupling effect generated by the parasitic capacitor in the display panel is to be alleviated, conventionally the process should be modified to reduce the parasitic capacitance, however, the modification of the process is likely to have an effect on other characteristics of the display panel, and the cost is relatively high.

SUMMARY OF THE INVENTION

In view of this, the object of the present invention is to provide a common voltage compensation device for liquid crystal display, a liquid crystal display and a driving method thereof, so as to alleviate the influence of the coupling effect of parasitic capacitance in the display panel on the common voltage of the liquid crystal display.

In order to achieve the above and other objects, the present invention provides a liquid crystal display for receiving and displaying an image signal. The image signal comprises a horizontal line signal with a plurality of pixel data, and two adjacent pixel data of the pixel data have opposite polarities.

The liquid crystal display comprises a timing controller, a compensation circuit and a display panel. The timing controller comprises a lookup table, a data analyzer and a polarity selector. A plurality of common voltage compensation values is built in the lookup table. The data analyzer performs an analysis of a gray scale distribution of the horizontal line signal, and then provides a value control signal from the lookup table according to the analysis result. The value control signal corresponds to one of the common voltage compensation values. The polarity selector provides a polarity control signal according to the analysis result of the data analyzer. The compensation circuit provides a common voltage compensation signal according to the value control signal and the polarity control signal. The display panel receives the horizontal line signal and the common voltage compensation signal, and compensates the common voltage by the common voltage compensation signal to display the horizontal line signal.

The present invention further provides a common voltage compensation device suitable for a display panel of a liquid crystal display. The common voltage compensation device is used for receiving and displaying an image signal, in which the image signal comprises a horizontal line signal with a plurality of pixel data, and two adjacent pixel data of the pixel data have opposite polarities. The common voltage compensation device comprises a lookup table, a data analyzer, a polarity selector and a compensation circuit. In one embodiment, when the data analyzer has analyzed that the gray scale distribution is that the difference of the amount of the odd pixel data of the horizontal line signal in a gray scale value range and the amount of the even pixel data of the horizontal line signal in the gray scale value range is greater than M and more than N times, the data analyzer will enable the compensation circuit to compensate the common voltage of the display panel by using the value control signal, wherein M and N are positive integers. And M and N can be adjusted according to the horizontal resolution or the size of the display panel, for example.

The present invention further provides a liquid crystal display driving method. The liquid crystal display driving method first receives an image signal, wherein the image signal comprises a horizontal line signal with a plurality of pixel data, and two adjacent pixel data of the pixel data have opposite polarities. The liquid crystal display driving method then analyzes the gray scale distribution of the horizontal line signal, and determines whether to compensate the common voltage according to the analysis result of the gray scale distribution, and determines the polarity of the voltage required to be compensated in order to compensate the common voltage when compensation is needed.

Since the present invention can analyze the data gray scale distribution by the front-end data analyzer and compensate the coupling effect resulting from the parasitic capacitance by using the compensation circuit; without modifying the process, the influence of the coupling effect on the display quality can be alleviated.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
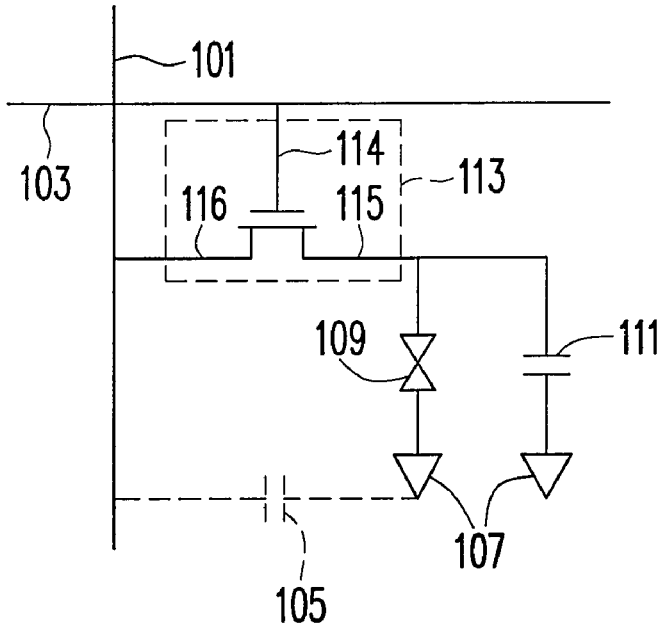
FIG. 1 (PRIOR ART)
FIG. 1 depicts a conventional pixel circuit of a liquid crystal display.
Figure 2:
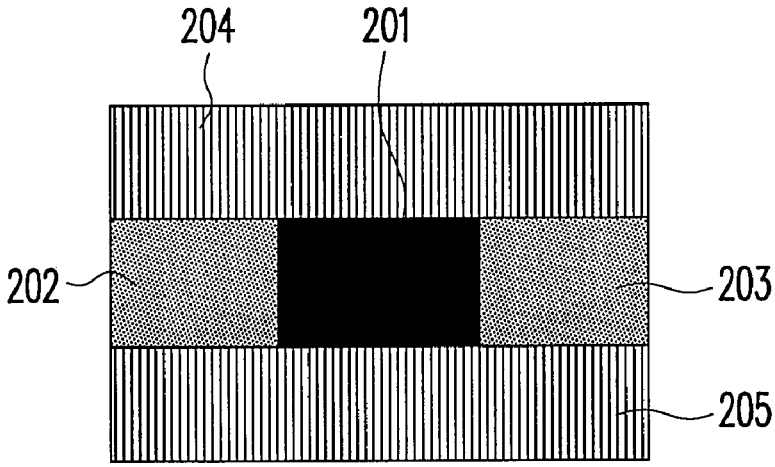
FIG. 2 (PRIOR ART)
FIG. 2 depicts the luminance difference between the two side regions and other regions of the black block.
Figure 3:
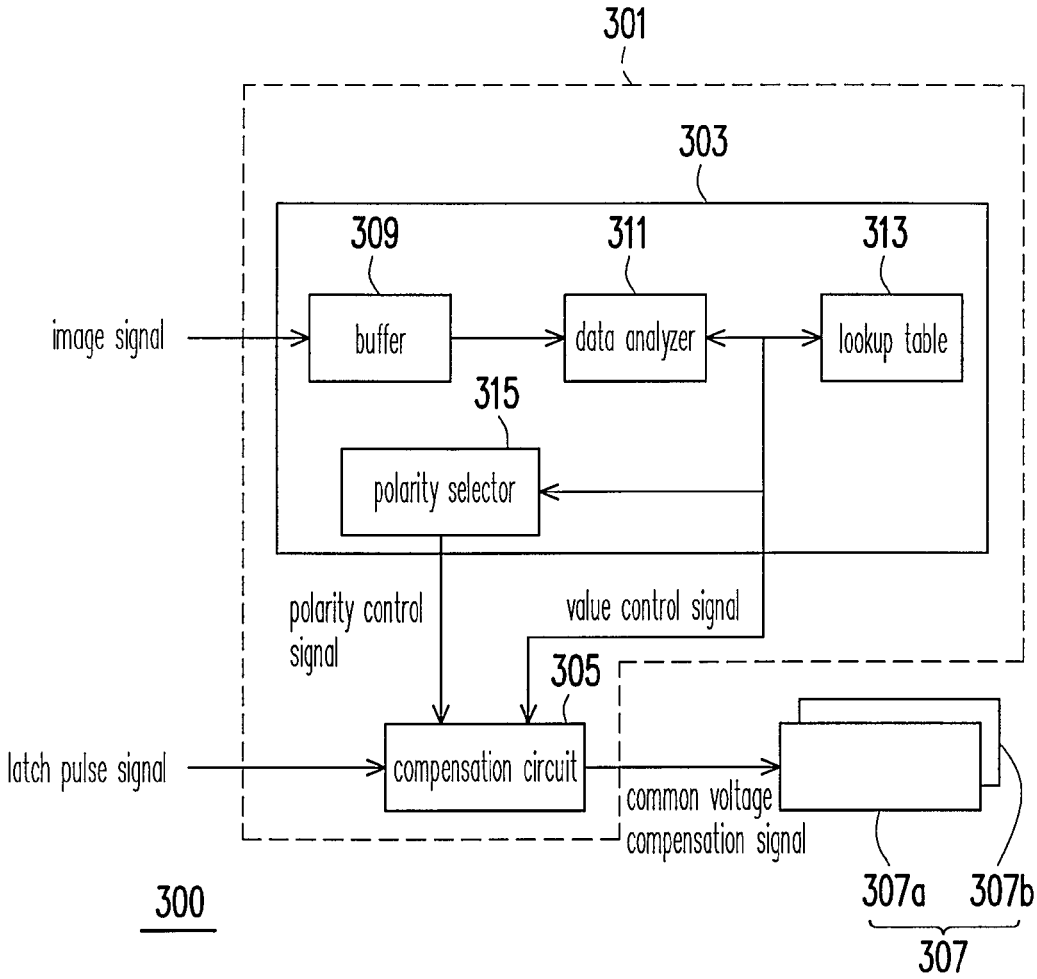
FIG. 3 depicts a block diagram of a liquid crystal display according to an embodiment of the present invention.

FIG. 3 depicts a block diagram of a liquid crystal display according to an embodiment of the present invention. Referring to FIG. 3, a liquid crystal display 300 comprises a common voltage compensation device 301 and a display panel 307. The common voltage compensation device 301 comprises a timing controller 303 and a compensation circuit 305, and the display panel 307 comprises a common electrode substrate 307*a* and an array circuit substrate 307*b* . The common electrode substrate 307*a* receives a common voltage signal. The array circuit substrate 307*b* receives an image signal. Liquid crystal molecules between the two substrates 307*a* and 307*b* are driven by the voltage difference between the common voltage signal and the image signal.

The compensation circuit 305 provides a common voltage compensation signal to the common electrode substrate 307*a* according to a value control signal output from a timing controller 303 and a polarity control signal in conjunction with a latch pulse signal. The latch pulse signal is a control signal for controlling the output of a source driver, and is generally provided by the timing controller 303. Therefore, the common electrode substrate 307*a* receives the common voltage compensation signal as well as the common voltage signal so as to compensate the voltage change in the common voltage of the common electrode substrate 307*a* owing to the coupling effect generated by the parasitic capacitor.

In the present embodiment, the timing controller 303 comprises a buffer 309, a data analyzer 311, a lookup table 313, and a polarity selector 315. The buffer 309 is used for receiving and registering the image signal, wherein the image signal is comprised of continuous frames, and each frame comprises a plurality of horizontal line signals. Each horizontal line signal has a plurality of pixel data, and two adjacent pixel data of the pixel data have opposite polarities. The data analyzer 311 receives the image signal output from the buffer 309 and performs an analysis of the gray scale distribution of each of the horizontal line signals of the image signal respectively.

In addition, the data analyzer 311 is respectively electrically connected to the lookup table 313, the polarity selector 315, and the compensation circuit 305. The data analyzer 311 compares the analysis result of the gray scale distribution with a plurality of common voltage compensation values built in the lookup table 313, and selects a common voltage compensation value from the lookup table 313 to output a corresponding value control signal to the compensation circuit 305. The analysis result of the gray scale distribution made by the data analyzer 311 is also provided to the polarity selector 315 in order to select the polarity of the horizontal line signal, and a corresponding polarity control signal is output from the polarity selector 315 to the compensation circuit 305.

Therefore, the value and the polarity of the common voltage compensation signal provided by the compensation circuit 305 are respectively determined by the value control signal and polarity control signal output from the timing controller 303, and the timing of the common voltage compensation signal is determined by the latch pulse signal. Generally, the time of sending the common voltage compensation signal is at the falling edge of the latch pulse signal.

As is known to all, display panel driving methods are generally categorized as frame inversion, column inversion, row inversion and dot inversion. The degradation of the display quality resulting from the property degradation of the liquid crystal molecules can be avoided by changing the polarities of the voltage driving the liquid crystal molecules. The present invention is suitable for liquid crystal displays employing driving methods such as dot inversion or column inversion.

Moreover, the driving method of a display panel is generally categorized as normally white or normally black. When the display panel is driven in a normally white method, the voltage difference between the white signal applied to the panel and the common voltage is relatively small, while the voltage difference between the black signal and the common voltage is relatively large, therefore the black signal will greatly influence the common voltage due to the coupling of the parasitic capacitance. Contrarily, when the display panel is driven in a normally black method, the white signal will greatly influence the common voltage. The present invention will be described as below by taking a display panel that is driven in a normally white, dot inversion method as an example. Any one skilled in the art can easily employ the inventive spirit of the present invention to display panels that are driven in a normally black method or in a column inversion method.

Figure 4:
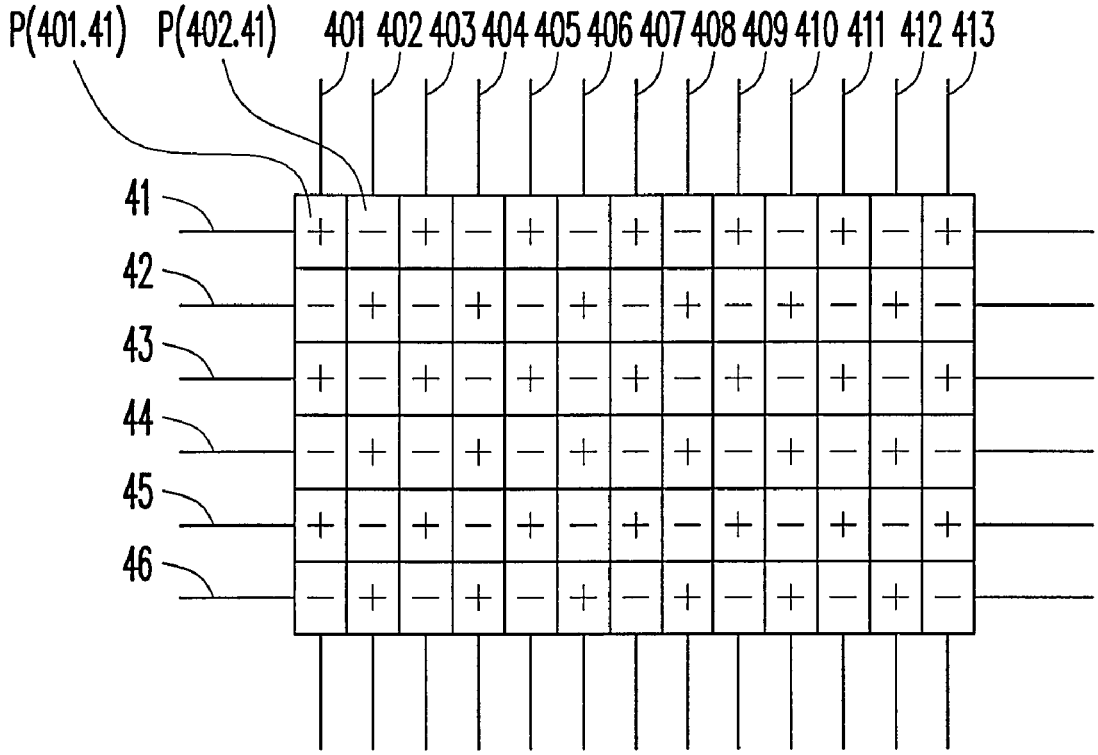
FIG. 4 depicts a schematic diagram of a polarity distribution of the pixel data of a frame when the frame is displayed on the display panel.

FIG. 4 depicts a schematic diagram of a polarity distribution of the pixel data in a frame when the frame is displayed on a display panel. The display panel employs the dot inversion driving method, wherein "+" denotes a positive polarity and "−" denotes a negative polarity. Referring to the display panel as shown in FIG. 4, the odd source lines on the display panel are sequentially marked with 401, 403, 405, and so forth, the even source lines are sequentially marked with 402, 404, 406, and so forth, and the gate lines are sequentially marked with 41~46. Pixels are disposed where each of the source lines 401~413 crosses each of the gate lines 41~46, and each pixel can register and display a pixel data. For convenient illustration, the pixel data registered and displayed by the pixel disposed where the source line 401 crosses the gate line 41 is defined as P(401,41), and the pixel data registered and displayed by the pixel disposed where the source line 402 crosses the gate line 41 is defined as P(402, 41), and so forth.

For example, when the gate line 41 is actuated with a pulse signal, a horizontal line signal is sent to the pixel through the source lines 401~413, wherein the horizontal line signal comprises the pixel data, P(401,41), P(402,41), P(403,41), . . . , P(413,41), and two adjacent pixel data of the pixel data P(401, 41)~P(413,41) have opposite polarities. Then, when the gate line 42 is actuated, another horizontal line signal comprising pixel data P(401,42)~P(413,42) is sent to the pixel, wherein two adjacent pixel data of the pixel data P(401,42)~P(413,42) have opposite polarities. And the adjacent pixel data in the pixel data P(401,42)~P(413,42) and the pixel data P(401, 41)~P(413,41) at corresponding positions also have opposite polarities. Therefore, the pixel data polarity distribution as shown in FIG. 4 can be realized by sequentially actuating the gate lines 41~46 and sending the corresponding pixel data to the pixel.

Moreover, if the polarity distribution of the pixel data shown in FIG. 4 is of a present frame, the polarity distribution of the pixel data of next frame has to be opposite to the present frame, i.e. the "+"s will change to the "−"s, and the "−"s will change to the "+"s, wherein the reversion of the polarity distribution of each frame is determined by the polarity POL provided, for example, by the polarity selector 315 in FIG. 3. For example, if the polarity POL is a positive polarity, the polarity of the pixel data P(401,41) is positive and the polarity of the pixel data P(402,41) is negative; on the contrary, if the polarity POL is a negative polarity, the polarity of the pixel data P(401,41) is negative and the polarity of the pixel data P(402,41) is positive.

Figure 5:
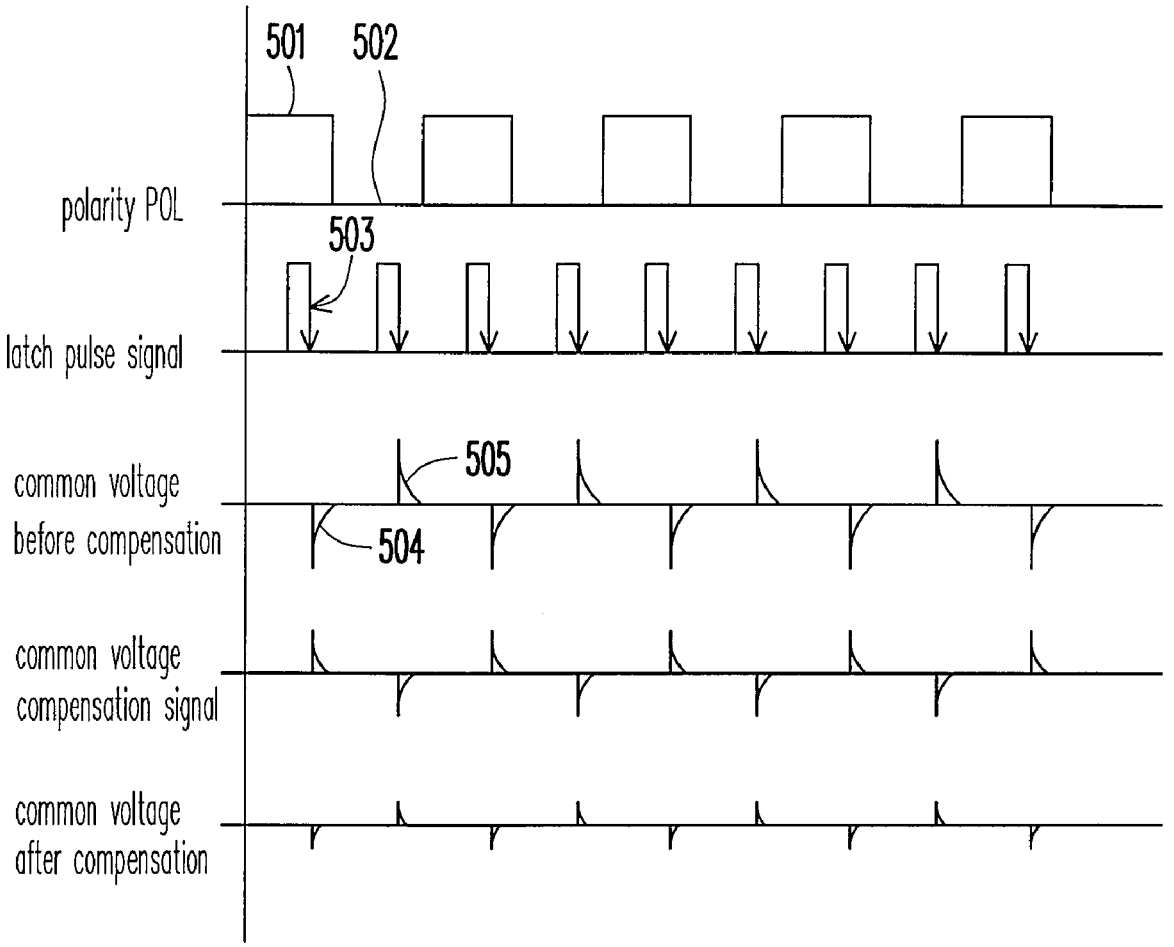
FIG. 5 depicts a timing diagram of the related signals in the liquid crystal display as shown in FIG. 3.

FIG. 5 depicts a timing diagram of related signals in the liquid crystal display 300 as shown in FIG. 3. Referring to FIG. 3 together with FIG. 4 and FIG. 5, the common voltage compensation device 301 provides a determination mechanism to determine whether to compensate the common voltage. This determination mechanism is that the data analyzer 311 performs an analysis on the amount of the odd pixel data of each horizontal line signal in the image signal that is in a gray scale value range, and on the amount of the even pixel data of each horizontal line signal that is in the gray scale value range. Taking a horizontal line signal which is sent in when the gate line 41 is actuated as an example, the horizontal line signal comprises the odd pixel data P(401,41), P(403, 41), . . . , P(413,41), and the even pixel data P(402,41), P(404,41), . . . , P(412,41).

Furthermore, taking an 8-bit gray scale (256 color scale) as an example, the gray scale value thereof is from 0 (all black) to 255 (all white). Since the black signal greatly influences the common voltage when the display panel is driven in a normally white method, only the amount of the odd pixel data (or the even pixel data) whose gray scale value falls in the above-mentioned gray scale value range is counted. In this embodiment, the gray scale value range is, for example, from 0 to 50.

When the amount of the odd pixel data that is in the gray scale value range equals to the amount of the even pixel data of the horizontal line signal in the gray scale value range, there is no need to compensate the common voltage. That is because the influences on the common voltage will be counteracted due to the opposite polarities of the odd pixel data and the even pixel data.

When the difference of the amount of the odd pixel data in the gray scale value range and the amount of the even pixel data of the horizontal line signal in the gray scale value range is greater than M and more than N times, the whole horizontal data line will influence the common voltage. For example, if the odd pixel data have negative polarities and the even pixel data have positive polarities, a reduced common voltage 504 will be generated when the polarity POL is a positive polarity 501 and is at the falling edge 503 of the latch pulse signal; and then an increased common voltage 505 will be generated when the polarity POL is a negative polarity 502 and is at the falling edge 503 of the latch pulse signal. Therefore, the compensation circuit 305 determines the size of the output common voltage compensation signal according to the value control signal output from the data analyzer 311, and determines the polarity of the output common voltage compensation signal according to the polarity control signal output from the polarity selector 315, so as to generate a proper common voltage compensation signal to compensate the common voltage.

For example, if the amount of the odd pixel data in the gray scale value range is 1000 and the amount of the even pixel data in the gray scale value range is 600, the difference thereof is 400 (=1000−600) and the former is 1.67 (=1000/600) times the latter. If it is assumed that the M and N are respectively adjusted to 300 and 2 according to, for example, the horizontal resolution of the display panel or the size of the display panel, there is no need to perform the common voltage compensation as the above difference is 400 (>M) and the times thereof is 1.67 (<N).

Figure 6:
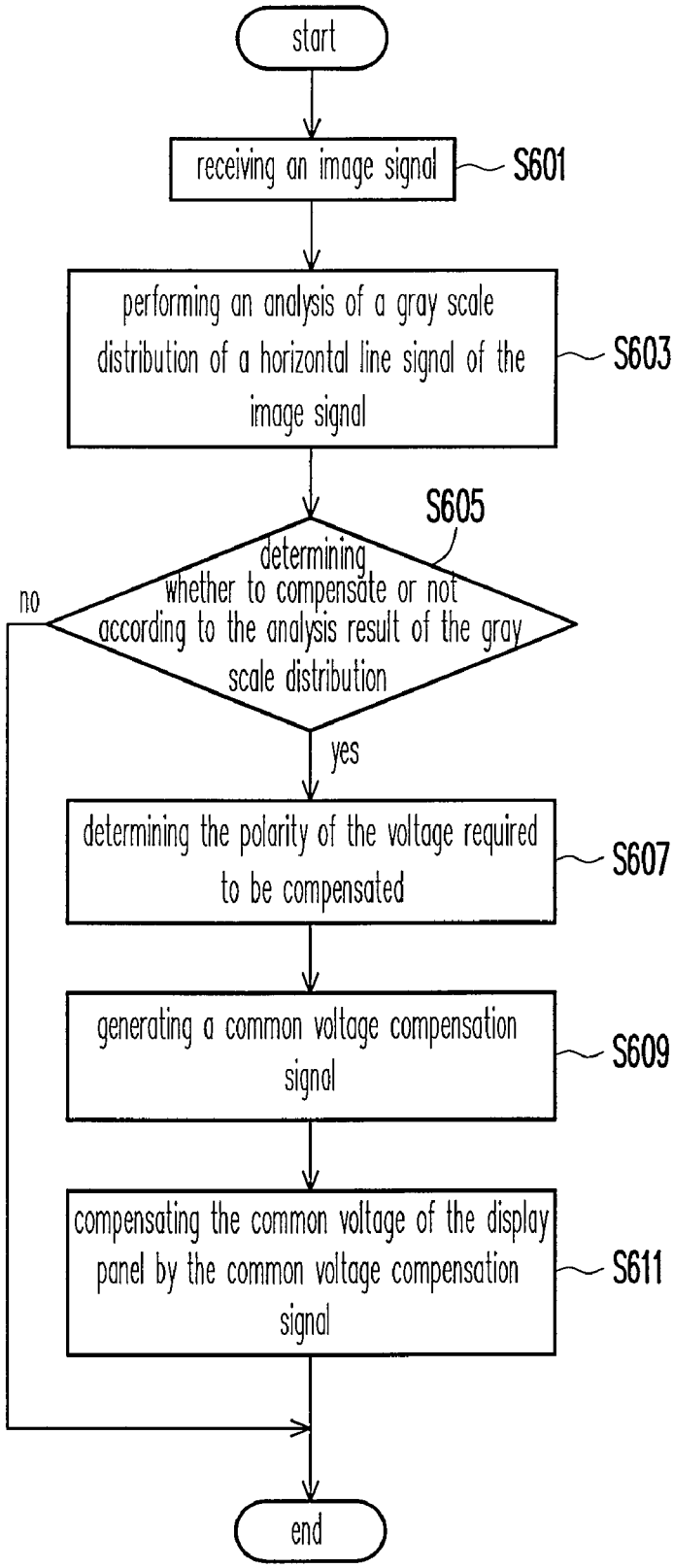
FIG. 6 depicts a flowchart of a liquid crystal display driving method according to an embodiment of the present invention.

FIG. 6 depicts a flowchart of a liquid crystal display driving method according to an embodiment of the present invention. Referring to FIG. 3 together with FIG. 6, firstly, in step S601, the liquid crystal display 300 receives an image signal, wherein the image signal comprises a horizontal line signal with a plurality of pixel data, and two adjacent pixel data of the pixel data have opposite polarities. In step S603, the data analyzer 311 performs an analysis of the gray scale distribution of a horizontal line signal of the image signal. Then, in step S605, it is determined whether to compensate the common voltage according to the analysis result of the gray scale distribution. If it is desired to perform the common voltage compensation, the polarity of the voltage required to be compensated is determined in step S607, and a common voltage compensation signal with a proper size and polarity is generated by the compensation circuit 305 in step S609, and the common voltage compensation signal is sent to the display panel 307 in step S611.

To sum up, the present invention can compensate the common voltage of a display panel influenced by the coupling effect of the parasitic capacitance without modifying the process because of adopting a common voltage compensation device to analyze the gray scale distribution of each horizontal line signal of the received image signal, thereby improving the display quality.

Although the present invention is disclosed as above by preferred embodiments, they are not intended to limit the present invention. Various variations and modifications can be made by those skilled in the art without departing from the spirit and scope of the present invention, and the scope of the present invention shall be defined by the appended claims.

What is claimed is:

1. A liquid crystal display for receiving and displaying an image signal, wherein the image signal comprises a horizontal line signal with a plurality of pixel data, and two adjacent pixel data of the pixel data have opposite polarities, the liquid crystal display comprising:

a timing controller, comprising:

a lookup table having a plurality of built-in common voltage compensation values;

a data analyzer for performing an analysis of a gray scale distribution of the horizontal line signal and providing a value control signal from the lookup table according to an analysis result based on a comparison between an amount of the even pixel data and an amount of the odd pixel data having a gray scale value in a gray scale value range, wherein the value control signal corresponds to one of the common voltage compensation values; and a polarity selector for providing a polarity control signal according to the analysis result of the data analyzer;

a compensation circuit for providing a common voltage compensation signal according to the value control signal and the polarity control signal; and a display panel for receiving the horizontal line signal and the common voltage compensation signal, and compensating a common voltage by the common voltage compensation signal to display the horizontal line signal.

2. The liquid crystal display as claimed in claim 1, wherein when the data analyzer finds that the gray scale distribution of the horizontal line signal is a difference greater than M of the amount of the odd pixel data and the amount of the even pixel data having a gray scale value in the gray scale value range, the data analyzer enables the compensation circuit to compensate the common voltage of the display panel by using the value control signal, wherein M is a positive integer.

3. The liquid crystal display as claimed in claim 1, wherein when the data analyzer finds that the gray scale distribution of the horizontal line signal is a ratio greater than N of the amount of the odd pixel data and the amount of the even pixel data having a gray scale value in the gray scale value range, the data analyzer enables the compensation circuit to compensate the common voltage of the display panel by using the value control signal, wherein N is a positive integer.

4. The liquid crystal display as claimed in claim 1, wherein when the data analyzer finds that the gray scale distribution of the horizontal line signal is a difference greater than M and a ratio greater than N of the amount of the odd pixel data and the amount of the even pixel data having a gray scale value in the gray scale value range, the data analyzer enables the compensation circuit to compensate the common voltage of the display panel by using the value control signal, wherein M and N are positive integers.

5. A common voltage compensation device suitable for a display panel of a liquid crystal display, for receiving and displaying an image signal, wherein the image signal comprises a horizontal line signal with a plurality of pixel data, and two adjacent pixel data of the pixel data have opposite polarities, the common voltage compensation device comprising:

a lookup table with a plurality of built-in common voltage compensation values;

a data analyzer for performing an analysis of a gray scale distribution of the horizontal line signal and providing a value control signal from the lookup table according to an analysis result based on a comparison between an amount of the even pixel data and an amount of the odd pixel data having a gray scale value in a gray scale value range, wherein the value control signal corresponds to one of the common voltage compensation values;

a polarity selector for providing a polarity control signal according to the analysis result of the data analyzer; and a compensation circuit for providing a common voltage compensation signal to the display panel according to the value control signal and the polarity control signal.

6. The common voltage compensation device as claimed in claim 5, wherein when the data analyzer finds that the gray scale distribution of the horizontal line signal is a difference greater than M of the amount of the odd pixel data and the amount of the even pixel data having a gray scale value in the gray scale value range, the data analyzer enables the compensation circuit to compensate the common voltage of the display panel by using the value control signal, wherein M is a positive integer.

7. The common voltage compensation device as claimed in claim 5, wherein when the data analyzer finds that the gray scale distribution of the horizontal line signal is a ratio greater than N of the amount of the odd pixel data and the amount of the even pixel data having a gray scale value in the gray scale value range, the data analyzer enables the compensation circuit to compensate the common voltage of the display panel by using the value control signal, wherein N is a positive integer.

8. The common voltage compensation device as claimed in claim 5, wherein when the data analyzer finds that the gray scale distribution of the horizontal line signal is a difference greater than M and a ratio greater than N of the amount of the odd pixel data and the amount of the even pixel data having a gray scale value in the gray scale value range, the data analyzer enables the compensation circuit to compensate the common voltage of the display panel by using the value control signal, wherein M and N are positive integers.

9. A liquid crystal display driving method, comprising:

receiving an image signal, wherein the image signal comprises a horizontal line signal with a plurality of pixel data, and two adjacent pixel data of the pixel data have opposite polarities;

performing an analysis of a gray scale distribution of the horizontal line signal based on a comparison between an amount of the even pixel data and an amount of the odd pixel data having a gray scale value in a gray scale value range;

determining whether to compensate a common voltage according to an analysis result of the gray scale distribution; and determining a polarity of the voltage required to be compensated to perform the common voltage compensation when the common voltage compensation is needed.

10. The liquid crystal display driving method as claimed in claim 9, wherein when the gray scale distribution of the horizontal line is analyzed that a difference of the amount of the odd pixel data and the amount of the even pixel data having a gray scale value in the gray scale value range is greater than M, the common voltage of the display panel is compensated, wherein M is a positive integer.

11. The liquid crystal display driving method as claimed in claim 9, wherein when the gray scale distribution of the horizontal line is analyzed that a ratio of the amount of the odd pixel data and the amount of the even pixel data having a gray scale value in the gray scale value range is greater than N, the common voltage of the display panel is compensated, wherein N is a positive integer.

12. The liquid crystal display driving method as claimed in claim 9, when the gray scale distribution of the horizontal line is analyzed that a difference of the amount of the odd pixel data and the amount of the even pixel data having a gray scale value in the gray scale value range is greater than M and a ratio greater than N, the common voltage of the display panel is compensated, wherein M and N are positive integers.

13. The liquid crystal display driving method as claimed in claim 9, when the analysis shows that the gray scale distribution of the horizontal line does not satisfy a condition that a difference of the amount of the odd pixel data and the amount of the even pixel data having a gray scale value in the gray scale value range is greater than M and a ratio greater than N, the common voltage of the display panel is not compensated, wherein M and N are positive integers.

* * * * *